US012330030B2

(12) United States Patent
Otterdahl et al.

(10) Patent No.: US 12,330,030 B2
(45) Date of Patent: Jun. 17, 2025

(54) ELECTRONIC GOLF FLAGSTICK

(71) Applicant: Ace Golf Technologies, Lake Elmo, MN (US)

(72) Inventors: David Otterdahl, Elko New Market, MN (US); Robert Szymborski, Prescott, WI (US); Dale Szymborski, Eden Prairie, MN (US)

(73) Assignee: Ace Golf Technologies, Lake Elmo, MN (US)

( * ) Notice: Subject to any disclaimer, the term of this patent is extended or adjusted under 35 U.S.C. 154(b) by 388 days.

(21) Appl. No.: 17/559,423

(22) Filed: Dec. 22, 2021

(65) Prior Publication Data

US 2022/0226707 A1 Jul. 21, 2022

Related U.S. Application Data

(60) Provisional application No. 63/139,712, filed on Jan. 20, 2021.

(51) Int. Cl.
*A63B 57/00* (2015.01)
*A63B 57/30* (2015.01)
*A63B 57/40* (2015.01)

(52) U.S. Cl.
CPC ..... *A63B 57/357* (2015.10); *A63B 2220/806* (2013.01)

(58) Field of Classification Search
CPC ..... A63B 57/357
See application file for complete search history.

(56) References Cited

U.S. PATENT DOCUMENTS 5,354,052 A * 10/1994 Nicholls ..... A63B 71/0669 473/192
5,884,913 A * 3/1999 Cohen ..... A63B 69/3694 473/192
8,398,500 B1 * 3/2013 Bouvier ..... A63B 69/3676 473/192
11,003,914 B2 5/2021 Imes
11,270,125 B2 3/2022 Imes
11,551,451 B2 1/2023 Imes
11,558,585 B2 1/2023 Imes
(Continued)

FOREIGN PATENT DOCUMENTS

AU 2020275846 A1 1/2022
AU 2021284458 A1 1/2023
(Continued)

*Primary Examiner* — Joshua T Kennedy
(74) *Attorney, Agent, or Firm* — Dorsey & Whitney LLP

(57) ABSTRACT

An electronic golf flagstick is configured for sensing objects proximate the golf flagstick. The electronic golf flagstick includes an elongated pole having a first end and a second end. The first end may be adapted to be removably secured to a surface, and the second end may be adapted to receive one or more accessories. The electronic golf flagstick includes a compartment assembly arranged between the first end and the second end, the compartment assembly comprising: at least one sensor; a processor coupled to memory; and power source configured to provide power to the sensor, processor and memory. The at least one sensor may be configured to sense an object on a ground surface approaching the golf flagstick. The processor coupled to memory may be configured to store the sensed information from the sensor.

20 Claims, 10 Drawing Sheets

(56) References Cited

U.S. PATENT DOCUMENTS

| | | | | |
|---|---|---|---|---|
| 11,601,623 | B2 | 3/2023 | Imes | |
| 11,860,517 | B2 * | 1/2024 | Aonuma | G02B 13/0065 |
| 2005/0192124 | A1 | 9/2005 | Tetens et al. | |
| 2009/0305803 | A1 * | 12/2009 | Reid | A63B 24/0021 473/150 |
| 2018/0021652 | A1 * | 1/2018 | Du Plessis | A63B 69/36 473/155 |
| 2020/0306586 | A1 * | 10/2020 | Cheung | A63B 57/357 |
| 2021/0260451 | A1 * | 8/2021 | Belton | A63B 57/405 |
| 2021/0383124 | A1 | 12/2021 | Imes | |
| 2022/0111284 | A1 * | 4/2022 | Wasag | A63B 71/0622 |
| 2022/0180636 | A1 | 6/2022 | Imes | |
| 2022/0383636 | A1 | 12/2022 | Imes | |
| 2022/0400202 | A1 | 12/2022 | Imes | |
| 2024/0017150 | A1 * | 1/2024 | Brigdale | H04N 7/183 |
| 2024/0207705 | A1 * | 6/2024 | Van Zandt | H04N 23/90 |

FOREIGN PATENT DOCUMENTS

| | | | | |
|---|---|---|---|---|
| CA | 3137575 | A1 | | 11/2020 |
| CA | 3180246 | A1 | | 12/2021 |
| EP | 3970358 | A1 | | 3/2022 |
| JP | 2008167244 | A | * | 7/2008 |
| JP | 2022533152 | A | | 7/2022 |
| KR | 20220061054 | A | | 5/2022 |
| KR | 20230021006 | A | | 2/2023 |
| WO | 2020232139 | A1 | | 11/2020 |
| WO | 2021248050 | A1 | | 12/2021 |

* cited by examiner

ELECTRONIC GOLF FLAGSTICK

CROSS-REFERENCE TO RELATED APPLICATIONS

This application claims priority to U.S. Provisional Patent Application No. 63/139,712, filed Jan. 20, 2021, entitled "ELECTRONIC GOLF FLAGSTICK" which is incorporated by reference herein, in the entirety and for all purposes.

FIELD

Implementations relate generally to golf flagsticks, and more particularly, to structures and systems that facilitate sensing objects proximate to the golf flagstick.

BACKGROUND

A golf flagstick, also referred to as a golf pin, may be used to mark a golf cup or hole on a green of a golf course. Golfers attempt to advance their golf ball towards the flagstick and into a cup of a golf hole during play. In conventional systems, the location of the golf ball relative to the cup is tracked visually by the golfers, traditionally without any assistance from sensors or other electronic-based tracking systems. Accordingly, where multiple golf balls are in play, it may be impossible or impractical to determine which ball is closest to the golf cup. And sensors, such as a camera, placed adjacent the golf green and away from the golf cup fail to capture visual data of the golf ball, and approach of the golf ball to the golf cup, from the perspective of the flagstick. As such, the need continues for systems and techniques to enhance object sensing proximate to the golf flagstick.

SUMMARY

Implementations provide electronic golf flagsticks. The electronic golf flagstick is configured for sensing objects proximate thereto. The electronic golf flagstick includes an elongated pole with a first end and a second end. The first end is adapted to be removably secured to a surface. The second end is adapted to receive one or more accessories. A compartment assembly arranged between the first end and the second end includes at least one sensor, a processor coupled to memory, and a self-contained power source configured to provide power to the sensor, processor, radio, and memory. The at least one sensor is configured to sense an object proximate the golf flagstick, including an object on a ground surface approaching the golf flagstick. In some cases, this may include sensing the object as being received in a golf cup. The processor coupled to memory is configured to store the sensed information from the sensor.

In another example, the at least one sensor may be configured to sense a net 360 degree view of the ground surface or ground surface and sky. Each of the at least one sensor may include a lens arranged at an angle of less than 90 degrees relative to the ground surface. The processor may be configured to analyze the sensed object proximate the electronic golf flagstick and determine the sensed object as being received by a golf cup in a single stroke. In this regard, the processor may be further configured to classify the sensed object as a hole-in-one. The processor may be further configured to analyze the sensed object approaching the electronic golf flagstick and calculate a distance of the object from the electronic golf flagstick. In some cases, the processor may be configured to calculate the distance of the object from the electronic golf flagstick for a plurality of object such that the processor calculates a relative distance of each object to the electronic golf flagstick. Further, the processor may be configured to sense GPS coordinates of at least one of the electronic golf flagstick or of the sensed object.

In another example, the at least one sensor includes a video camera configured to record a video of the object. The video camera records a 180 degree video of an area proximate the object. The processor may be configured to transmit the recorded video over a computer network. In some cases, at least two video cameras record the video of the object. Additionally or alternatively, the at least one sensor may include a LIDAR sensor.

In another example, the compartment includes one or more seals. An external portion of the housing may include a protrusion arranged above each of the at least one sensor. The processor may be communicatively coupled to a computer network. The power source may be rechargeable. The compartment may include a tubular housing with an enlarged diameter relative to a diameter of the elongated pole.

In another example, the one or more accessories comprises a flag. The surface may be configured as a tubular wall. The first end of the elongated pole may include a base with a shape complementary to the tubular wall such that the base of the elongated pole may be removably inserted into an opening defined by the tubular wall. In this regard, the surface may be formed by a golf cup of a golf hole.

In addition to the exemplary aspects and embodiments described above, further aspects and embodiments will become apparent by reference to the drawings and by study of the following description.

DETAILED DESCRIPTION

Implementations provide systems, methods, and apparatuses that embody various elements of the present disclosure. However, it should be understood that the disclosed embodiments may be practiced in a variety of forms in addition to those described herein.

Figure 1:
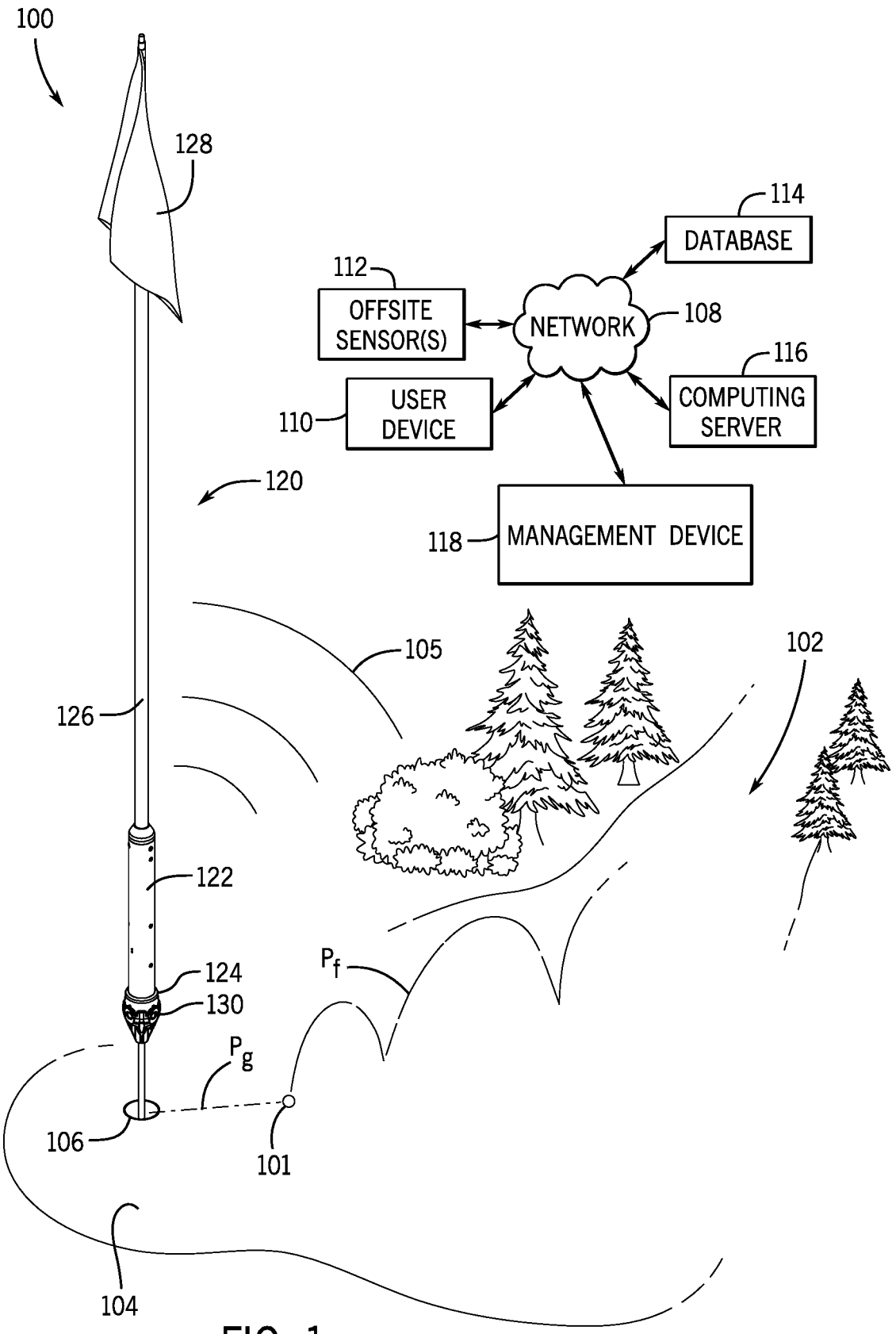
FIG. 1 depicts an electronic golf flagstick arranged with a golf cup of a golf hole, according to implementations of the present disclosure.

FIG. 1 depicts a system 100 including an electronic golf flagstick 120 arranged in a golfing environment 102 such as a golf course. The golfing environment 102 may be a golf course or other area where golf or a related activity is played. The golfing environment 102 shown in FIG. 1 includes a golf green 104 and a golf cup 106. The electronic golf flagstick 120 is arranged at the golf cup 106. It will be appreciated that the golf flagstick 120 may also be selectively positionable in other environments, including a tee box, adjacent to a green, within a bunker, in a tree, on a building, fence, pole, bleachers, and so on. In the illustration of FIG. 1, the electronic golf flagstick 120 may be configured to sense an object proximate the golf cup 106. For example, a golf ball 101 is shown in FIG. 1. The golf ball 101 may follow a flight path $P_f$ as the golf ball 101 is advanced toward the golf cup 106. In some cases, the golf ball 101 may subsequently follow a green path $P_g$ toward the golf cup 106 for receipt of the golf ball 101 in the golf cup 106.

In the illustration of FIG. 1, the electronic golf flagstick 120 is shown with a compartment assembly 122 and a sensor array 124. Compartment assembly 122 and the sensor array 124 may be integrated with an elongated pole 126 or other structure that extends substantially vertically from the golf cup 106 to visually mark a location of the golf hole. An accessory 128 such as a flag may be secured to an end of the elongated pole 126. As explained herein, the compartment assembly 122 may be configured to house various electronic components of the electronic golf flagstick 120 to facilitate performing the functions described herein. The sensor array 124 may be configured to house at least one sensor for sensing the golf ball 101 or other objects proximate to the golf cup 106. As shown in FIG. 1, a sensor 130 is provided at the sensor array 124. The sensor 130 may include a camera that is configured to detect one or more characteristics of the golf ball 101, including a position, a trajectory, and/or a visual depiction of the golf ball 101 along one or both of the flight path $P_f$ or the green path $P_g$, including capturing images of golf ball 101 being received by the golf cup 106.

The electronic golf flagstick 120 may be configured to transmit signals 105 over a communicatively coupled network 108. For example, the electronic golf flagstick may include a communications component and an antenna integrated with the compartment assembly 122 and/or the elongated pole 126. The network 108 may, for example, be a wireless or cellular network that facilitates the transmission of data among various components of the system 100. The network 108 may include two or more communication methods (e.g., cellular, Bluetooth and/or Wi-Fi) to communicatively couple the system 100 elements. The network 108 may include wireless and wired transmission methods, such as, but not limited to, cellular, Wi-Fi, radio transmissions, Ethernet, local area network, ZigBee, wide area networks, and so on.

The network 108 may be communicatively coupled to a variety of different components, devices, and systems to facilitate the analysis, processing, and communication of information associated with the data collected by the sensor (s) of the electronic golf flagstick 120. For example, the system 100 may include one or more user devices 110 that interact with the system 100 via the network 108. The system 100 may communicatively couple to multiple user devices 110, allowing individual users to interact separately with the system 100 via separate user devices 110. The user device 110 may be any type of computing device that may transmit and receive data from other computing devices. For example, the user device 110 may be a smartphone, tablet computer, wearable device, laptop, and so on. The user device 110 may include a display or screen that allows a user to receive information, including videos or other visual representations of the golf ball 101. The user device 110 may be in electronic communication with one or more other devices of the system 100, including the electronic golf flagstick 120, either directly, or via the network 108.

The system 100 may also include one or more optional offsite or remote sensors 112. For example, the offsite sensor(s) 112 may be a temperature sensor or other device that is used for the detection of ambient conditions during a game of golf. The offsite sensor 112 may more generally be any other sensor that provides supplemental information to the network 108 associated with the golf ball 101, golfers, golfing environment 102, and so on.

The system may also include computing server 116. The computing server 116 may be configured to receive information from the electronic golf flagstick 120, the user device 110, and/or the onsite sensor(s) 112. In some embodiments, the computing server 116 may include one or more computing devices (e.g., servers, computers, etc.), that may be a single device or multiple devices operating in a distributed environment. The system 100 may also include one or more databases 114 that may store information related to or used by components of the system 100. For example, the databases 114 may include databases that store information associated with the golfing environment 102, the golf ball 101, golfers, and so on, which may be used to produce information in conjunction with the data collected at the golf flagstick 120. The type, structure, and data stored within the various databases 114 may be varied depending on the types of detected characteristics of the golf ball 101 or other object detected, and desired informational output.

The system 100 may optionally include one or more management devices 118. The management device 118 may be any type of computing device that may transmit and receive data from other computing devices. For example, the management device 118 may be a server, smartphone, tablet computer, wearable device, laptop, and combinations thereof. The management device 118 may be in electronic communication with one or more other devices of the system 100, either directly, or via a network 108. The management device 118 may be used to manage the electronic golf flagstick 120 and/or user devices 110 that interact with the system 100. In various implementations, the management device 118 may be configured to display data that may correspond, for example, to a distance of the golf ball 101 to the golf cup 106. Additionally, the management device 118 may be used to determine and/or display information indicative of whether the golf ball 101 is the closest to the golf cup 106 from a group of golf balls in play, as well as whether the golf ball 101 has satisfied any other conditions (e.g., within a range from the golf cup 106, received by the golf cup 106, hole-in-one, and so on).

Figure 2:
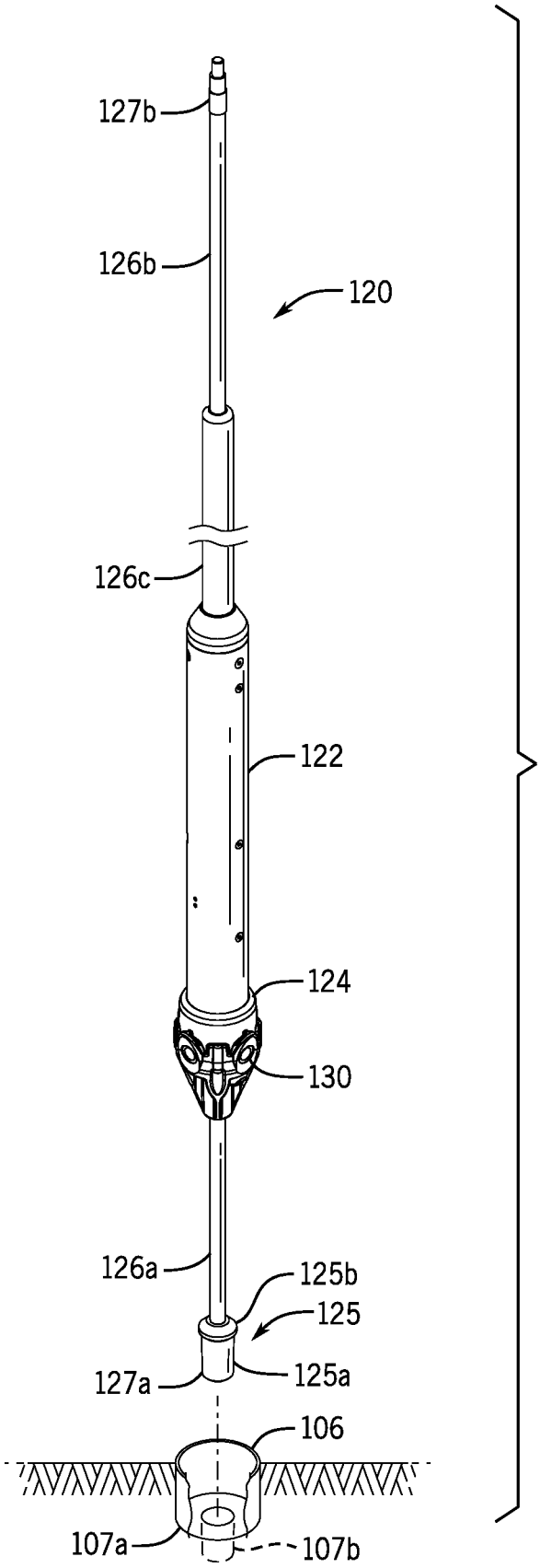
FIG. 2 depicts a partial exploded view of the electronic golf flagstick and the golf cup.

Turning to FIG. 2, a partial exploded view of the electronic golf flagstick 120 and the golf cup 106 are shown. The electronic golf flagstick 120 may include an elongated pole first portion 126*a* that is configured to facilitate attachment of the flagstick 120 to the golf cup 106. For example, the elongated pole first portion 126*a* may define a first end 127*a* of the flagstick 120 that is adapted to be removably secured to a surface. The surface may be a surface formed by the golf cup 106 of the golf hole. In the example of FIG. 2, the golf cup 106 includes a golf cup first surface 107*a* and a golf cup second surface 107*b*. The golf cup second surface 107*b* may define a receiving portion of the golf cup 106 that is configured to receive the first end 127*a* of the flagstick 120. The golf cup first surface 107*a* may be a surface that extends annularly about the golf cup second surface 107*b*. The golf ball 101 may advance toward the golf cup 106 and be received by the golf cup first surface 107*a*.

The electronic golf flagstick 120 may include a mating feature 125 at the first end 127*a* to facilitate the removable attachment of the flagstick 120 and the golf cup 106. The mating feature 125 may include a flange portion 125*a* and an engagement portion 125*b*. The engagement portion 125*b* may be defined a substantially cylindrical shape that is configured to match a shape of the golf cup 106 defined by the golf cup first surface 107*a*. The flange portion 125*a* may define a rim about the engagement portion 125*b* to limit advancement of the first end 127*a* into the golf cup 106.

Figure 9:
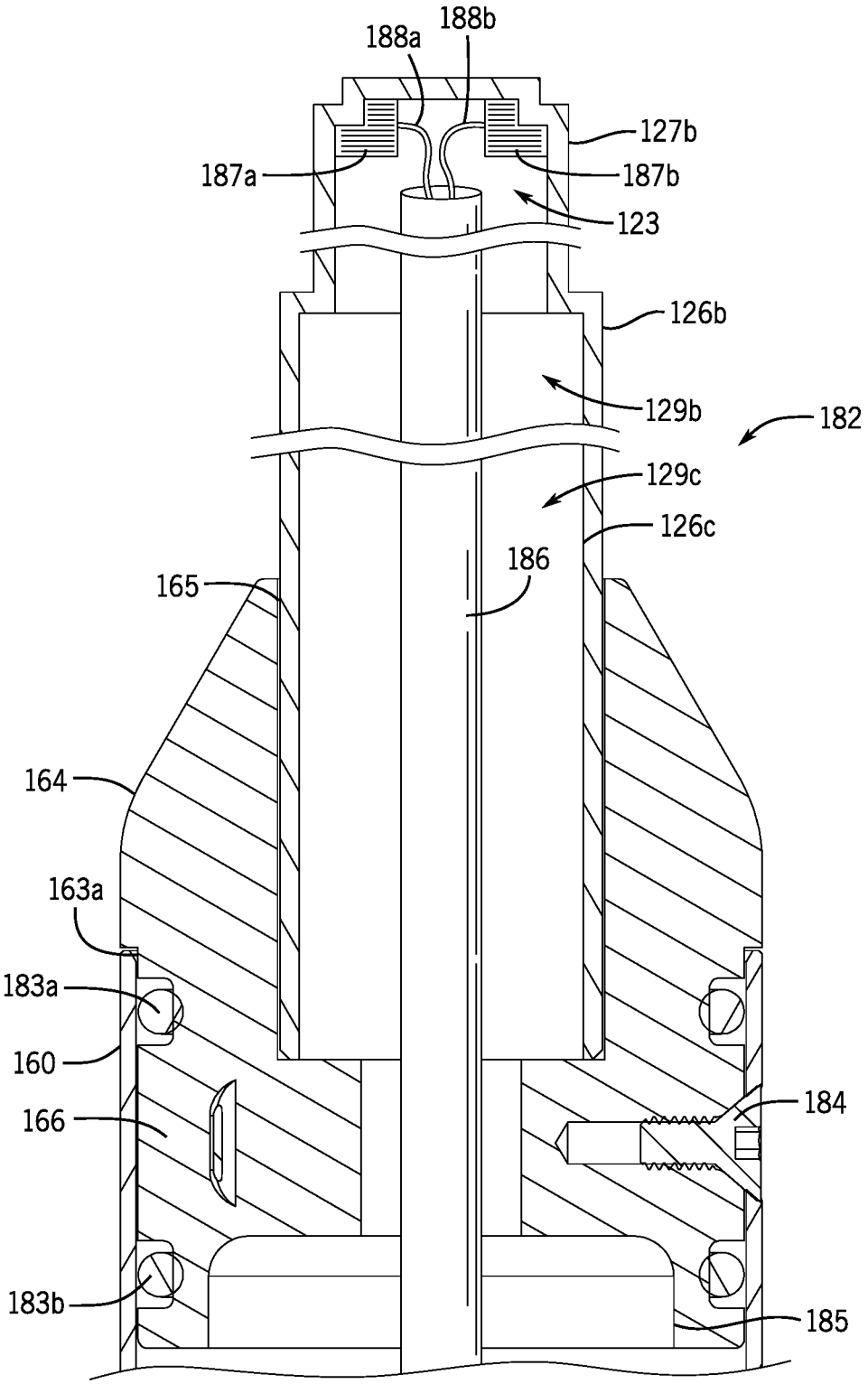
FIG. 9 depicts detail 9-9 of FIG. 3.

The electronic golf flagstick 120 defines a second end 127*b* that is adapted to receive one or more accessories. For example, an elongated pole second portion 126*b* may be positioned opposite the elongated pole first portion 126*a* and define the second end 127*b*. In some cases, one or more antennas may be arranged at or adjacent to the second end 127*b*. The second end 127*b* may be constructed in a manner to house an array of antennas, including at least two antennas that are diametrically opposed to one another. For example and as shown in FIG. 9, a first antenna 187*a* and a second antenna 187*b* may be arranged diametrically opposed to one another substantially within an end volume 123 at the second end 127*b*. In this regard, the antennas 187*a*, 187*b* may be arranged at an elevationally higher position within the electronic golf flagstick 120 than other components of the flagstick 120 that could otherwise impact electromagnetic radiation of an antenna, such as a metal housing and/or other electronic components. Additionally, the accessory 128 may be secured to the electronic golf flagstick at the second end 127*b*.

In the example of FIGS. 2 and 9, an elongated pole third portion 126*c* is also shown. The elongated pole third portion 126*c* may be coupled to the elongated pole second portion 126*b*. The elongated pole second and third portions 126*b*, 126*c* may cooperate to define a passage or other housing for cables. For example, the elongated pole second portion 126*b* may define a second portion volume 129*b* and the elongated pole third portion 126*c* may define a third portion volume 129*c*. Interior cables extend through the second and third portion volumes 129*b*, 129*c* to connect communications components within the compartment assembly 122 to the antennas 187*a*, 187*b* at or adjacent the second end 127*b*. As further shown in FIG. 2, the elongated pole third portion 126*c* optionally has a diameter that is greater than the elongated pole first and second portions 126*a*, 126*b*. In some cases, the elongated pole first, second, third portions 126*a*, 126*b*, 126*c* may be separate structures that are attached to one, such as being attached via a connection with the compartment assembly 122 and/or sensor array 124. In other cases, the elongated pole first, second, third portions 126*a*, 126*b*, 126*c* may be portions of a continuous or one-piece structure, and the compartment assembly 122 and/or the sensor array 124 can fit over and/or attach to the one-piece structure.

Figure 3:
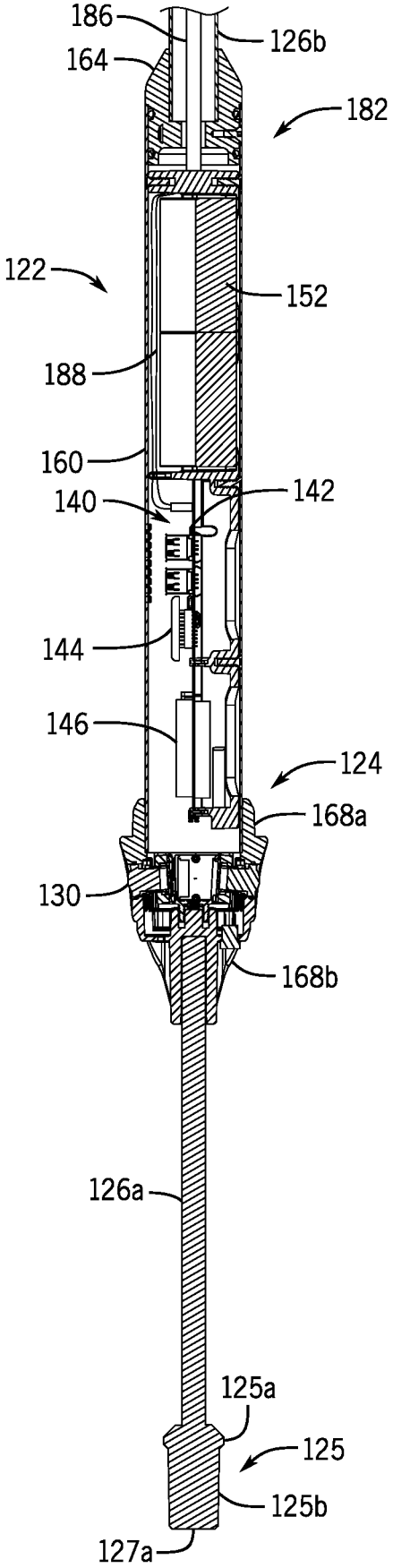
FIG. 3 depicts a cross-sectional view of the electronic golf flagstick of FIG. 2, taken along line 3-3 of FIG. 2.
Figure 4:
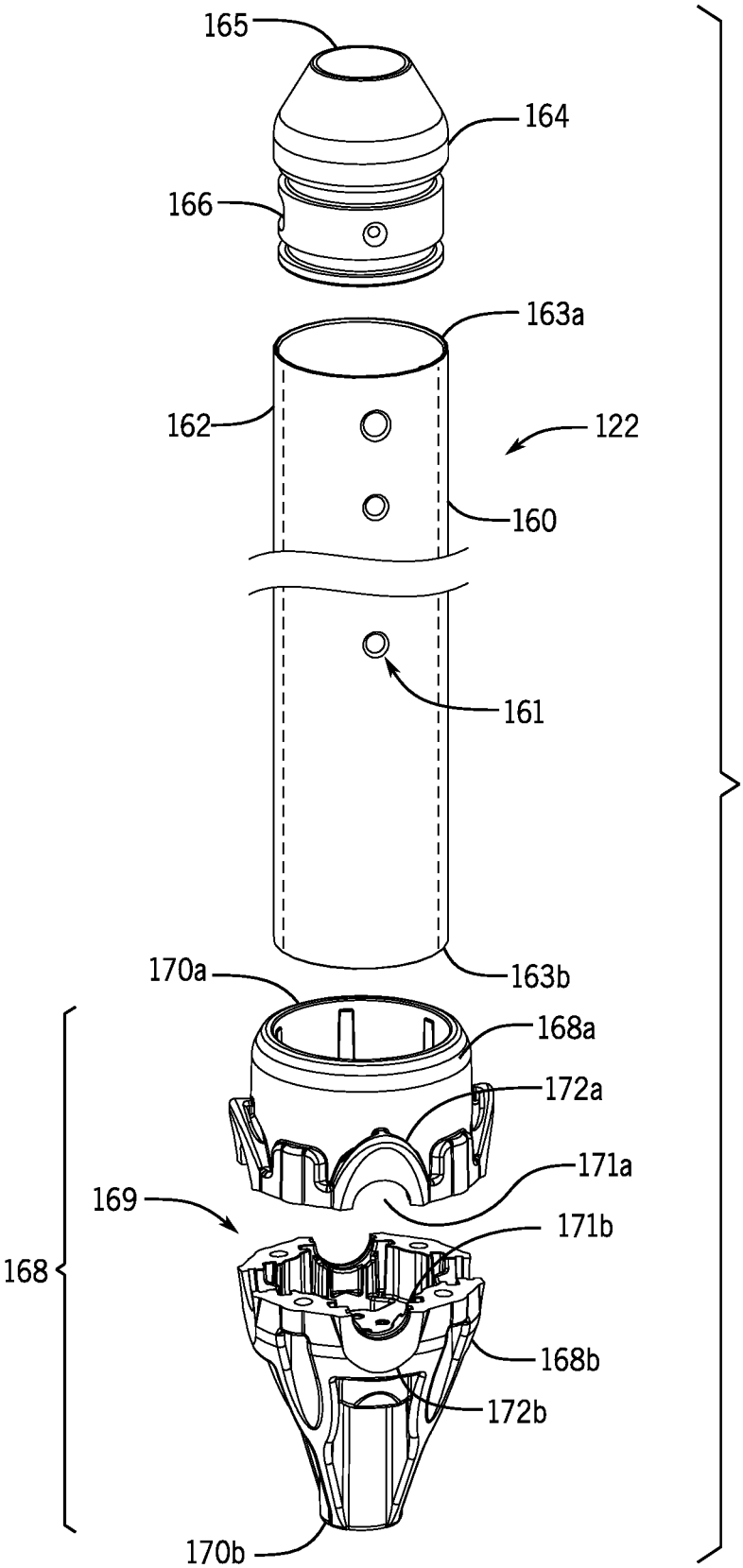
FIG. 4 depicts an exploded view of a compartment assembly of the electronic golf flagstick of FIG. 2.

With reference to FIGS. 3 and 4, the electronic golf flagstick 120 is shown as including the compartment assembly 122. The compartment assembly 122 may define a collection of structural components that house the various electrical components and/or sensors described herein. For example, the compartment assembly 122 may include a tube 160. The tube 160 may be a substantially cylindrical structure having tube walls 162 that define a tube volume 161. The tube walls 162 may define a tube first opening 163*a* and tube second opening 163*b*. The tube first and second openings 163*a*, 163*b* may extend into the tube volume 161. The compartment assembly 122 may further include a cap 164. The cap 164 may be a closure or other feature of the compartment assembly 122 adapted to seal an end of the tube 160 about the elongated pole 126. The cap 164 is shown with an elongated pole opening 165 extending into a body of the cap 164. The elongated pole opening 165 may be configured to receive a portion of the elongated pole 126 or other structure that visually indicates a location of the golf cup 106. A fitting portion 166 is defined by an end of the cap 164 opposite the elongated pole opening 165. The tube first opening 163*a* may be adapted to receive the fitting portion 166 of the cap 164 and establish a friction fit therebetween. Fasteners or other attachment mechanisms may be used to secure to the cap 164 and the tube 160 to one another.

The compartment assembly 122 is further shown in FIGS. 3 and 4 as including a sensor array housing 168. The sensor array housing 168 may generally be configured to support the at least one sensor 130 of the electronic golf flagstick 120, including supporting the sensor 130 at a desired angle or orientation relative to a ground surface. The sensor array housing 168 may also be configured to shield the sensor 130 from debris or force impact of the golfing environment 102.

In the illustrated example, the sensor array housing 168 includes a sensor array housing first portion 168*a* and a sensor array housing second portion 168*b*. The sensor array housing first portion 168*a* and the second array housing second portion 168*b* may cooperate to define a sensor array housing volume 169. The at least one sensor 130 may be arranged in the sensor housing volume 169 and may be generally held in place by the second array housing first and second portions 168*a*, 168*b*. For example, the sensor housing first portion 168*a* defines a sensor top support feature 171*a* that is configured to engage a top surface or contour of the sensor 130. Further, the sensor housing second portion 168*b* defines a sensor bottom support feature 171*b* that is configured to engage a bottom surface or contour of the sensor 130. In some cases, the sensor housing top and bottom support features 171*a*, 171*b* may cooperate to engage a substantial entirety of a perimeter of the sensor 130.

With reference to shielding the sensor 130 from a force impact, the sensor housing first portion 168*a* may define a sensor top shield feature 172*a*. The sensor top shield feature 172*a* may define a protrusion or other feature that extends from the sensor housing first portion 168*a* beyond an outermost surface of the sensor 130. Further, the sensor housing second portion 168*b* may define a sensor bottom shield feature 172*b*. The sensor bottom shield feature 172*b* may define a protrusion or other feature that extends from the sensor housing second portion 168*b* beyond the outermost surface of the sensor 130. Accordingly, in the event that the electronic golf flagstick 120 is placed on a ground surface, the protrusions may contact the ground surface and thus cooperate to define an offset between the outermost surface of the sensor 130 and the ground, as shown and described below with respect to FIG. 8. In addition, the protrusions may deflect a golf ball 101 before the golf ball 101 can impact the sensor 130 thereby avoiding damage to the sensor.

The sensor housing first portion 168*a* is shown as having a fitting portion 170*a*. The fitting portion 170*a* may be an opening extending in to a body of the sensor housing first portion 168*a*. In an assembled configuration, the tube 160 may be received by the fitting portion 170*a*. The tube second opening 163*b* may extend at least partially into the sensor housing first portion 168*a* in order to connect the tube volume 161 and the sensor housing volume 169 to one another. The sensor housing second portion 168*b* is shown as having a fitting portion 170*b*. The fitting portion 170*b* may be an opening extending in to a body of the sensor housing second portion 168*b*. In an assembled configuration, the elongated pole 126 may be received by the fitting 170*b*.

The compartment assembly 122 may be configured to house a computing assembly 140 of the electronic golf flagstick 120. The computing assembly 140 may include various electrical and associated components that cooperate to facilitate one or more of the functions of the electronic golf flagstick 120 described herein. While many variations are possible and described herein, the computing assembly is shown with reference to FIG. 5 as including a computing assembly mounting structure 141. The computing assembly mounting structure 141 may be a structural portion of the computing assembly 140 upon which one or more electronic components of the computing assembly 140 are secured. The computing assembly mounting structure 141 may also be configured for removable engagement with the compartment assembly 122, for example, including having a size and shape to match the tube volume 161 or otherwise fit inside the tube 160. The computing assembly mounting structure 141 may define a circuit board portion 141*a* that defines a mounting surface for a circuit board. The computing assembly mounting structure 141 may further define a power source portion 141*b* that defines a receiving area for a power source. While many constructions are possible, the computing assembly mounting structure 141 of FIG. 5 may be formed from a plastic material. The plastic material can be slid into the aluminum construction of the tube 160 for assembly.

Figure 5:
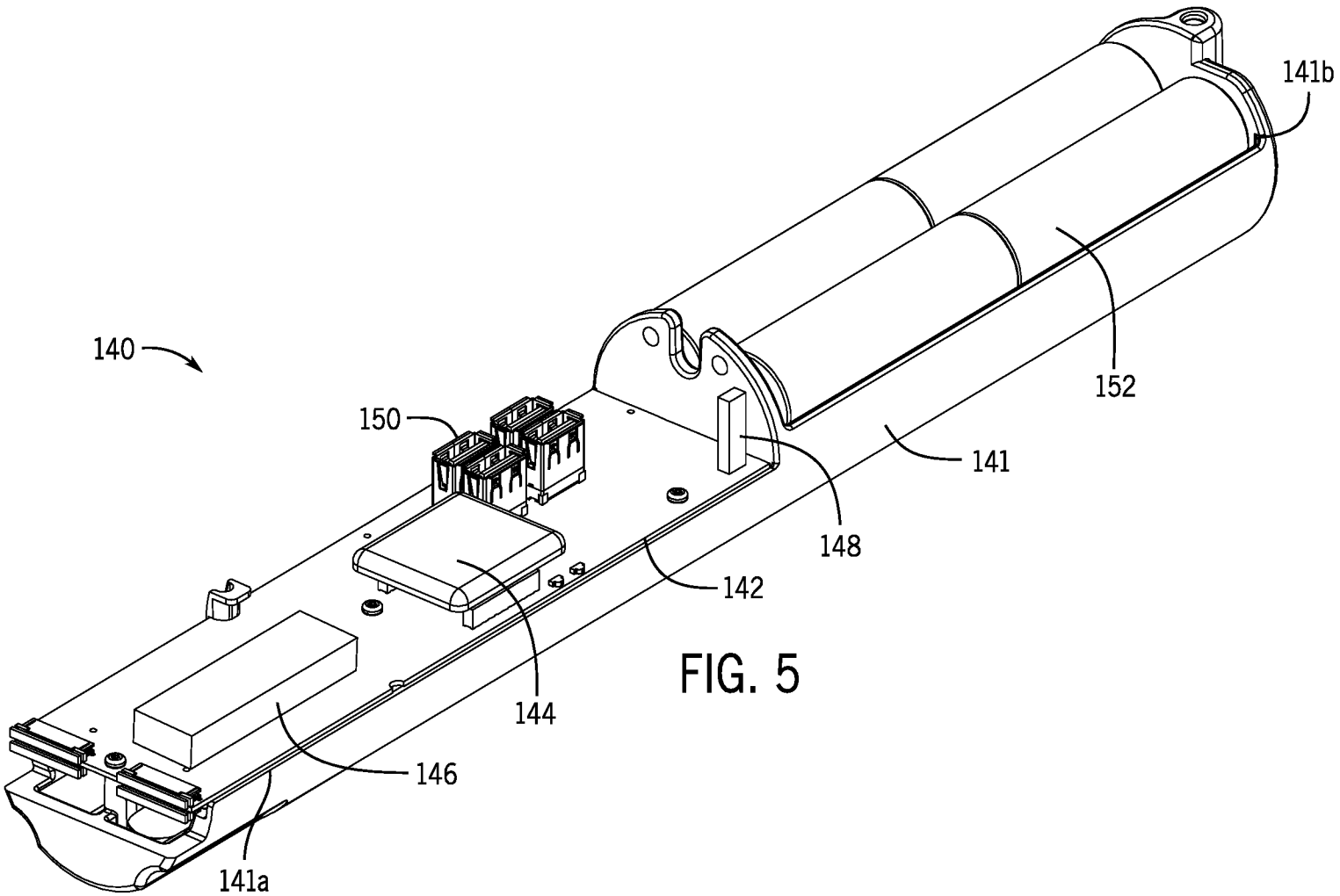
FIG. 5 depicts a computing assembly of the electronic golf flagstick of FIG. 2.

The computing assembly 140 is shown in FIG. 5 as including a circuit board 142. Generally, the circuit board 142 may be a printed circuit board or (PCB) that includes one or more processing elements, computer processors or microcontrollers that are configured to perform operations in response to computer-readable instructions. For example and as shown in FIG. 5, the circuit board 142 may include a processor and memory component 144. The processor and memory component 144 may include or be a central processing unit of the electronic golf flagstick 120. Additionally or alternatively, other processing elements may be incorporated within the electronic golf flagstick 120, including application specific integrated chips (ASIC) and other microcontroller devices. In some cases, the circuit board 142 may also include a memory component 146, including a variety of types of non-transitory computer-readable storage media, including, for example, read access memory (RAM), read-only memory (ROM), erasable programmable memory (e.g., EPROM and EEPROM), or flash memory. The computing assembly 140 may therefore be configured to store computer-readable instructions, sensor values, and other software elements. The processing elements or other like components of the circuit board 142 may be operable to read computer-readable instructions stored on the memory and/or computer-readable media. The computer-readable instructions may adapt the processing elements to perform the operations or functions described above. The computer-readable instructions may be provided as a computer program product, software application, or the like.

The circuit board 142 is further shown as having a communications component 148. Broadly, the communications component 148 may include or be a component that facilitates the transmission of signals to and from the electronic golf flagstick 120. As one example, the communications component 148 may be a component of an antenna that is used to send and receive signals via a cellular network, Wi-Fi, radio transmissions, Ethernet, local area network, ZigBee, wide area networks, among other possibilities. The communications component 148 may be connected to an antenna that is positioned elevationally higher in the electronic golf flagstick 120 than the computing assembly 140 which may enhance performance of the communications component 148, such as the antennas 187*a*, 187*b* shown in FIG. 9. For instance, wires 188 may extend substantially from the communications component 148 and into the elongated pole third portion 126*c* to couple the communications component 148 to the antennas 187*a*, 187*b*. The wires 188 may terminate at this portion or may extend further into and along the elongated pole second portion 126*b*, such as extending to the second end 127*b*, based on a location of the antennas 187*a*, 187*b* in the electronic golf flagstick 120. In some cases, one or more peripheral attachment components 150 is also provided with the circuit board 142. The peripheral attachment component 150 may include a USB port or other feature that is configured to commutatively couple a peripheral device, e.g., a computing device, memory card, and so on, directly to the circuit board 142.

The computing assembly 140 is also shown as including a power source 152. The power source 152 is a self-contained onboard power source of the electronic golf flagstick 120. The power source 152 may allow the flagstick 120 to operate without the need for a hardwired connection to an external power source, often for an extended period of time. The power source 152 shown in FIG. 5 includes a collection of batteries. The batteries may be rechargeable batteries. In some cases, the power source 152 may be rechargeable using one or more components of the flagstick 120, including an optional function of solar charging or other techniques.

In some implementations, the power source 152 may be powered on and off in response to receiving a signal from an actuation switch 180 of the electronic golf flagstick 120. In addition or alternatively, the computing assembly 140 may cause the power source 152 to transition to a power-saving or sleep mode where one or more components of the electronic golf flagstick 120 are inactive. For instance, after determining the sensor 130 has been inactive after a predefined period of time, the computing assembly 140 (e.g., processor) may cause the power source 152 to conserve power and cease sensing or other power-intensive operations. In this state, the electronic golf flagstick 120 may continue to receive signals from external devices over the network 108, and may transition to an active mode, for instance, where the sensor 130 senses the environment surrounding the electronic golf flagstick 120. More particularly, a user device 110 at or proximate the golf environment 102 may communicatively couple to the electronic golf flagstick 120 via the network 108 and the computing assembly 140 may cause the sensor 130 to actively sense the golf environment 102 to identify a golf ball 101 as well as other objects proximate the electronic golf flagstick 120.

Figure 6:
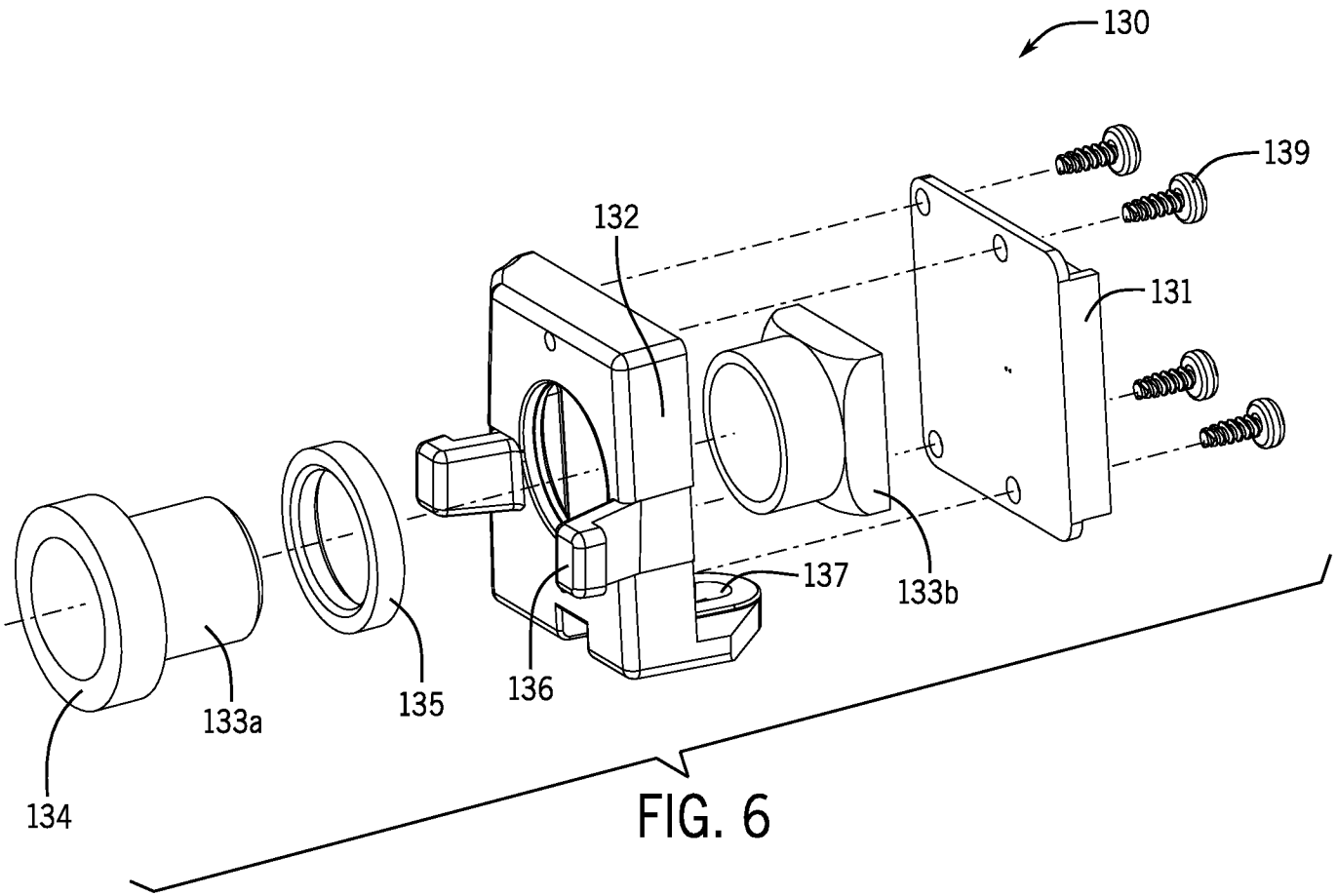
FIG. 6 depicts an exploded view of a camera assembly of the electronic golf flagstick of FIG. 2.
Figure 7:
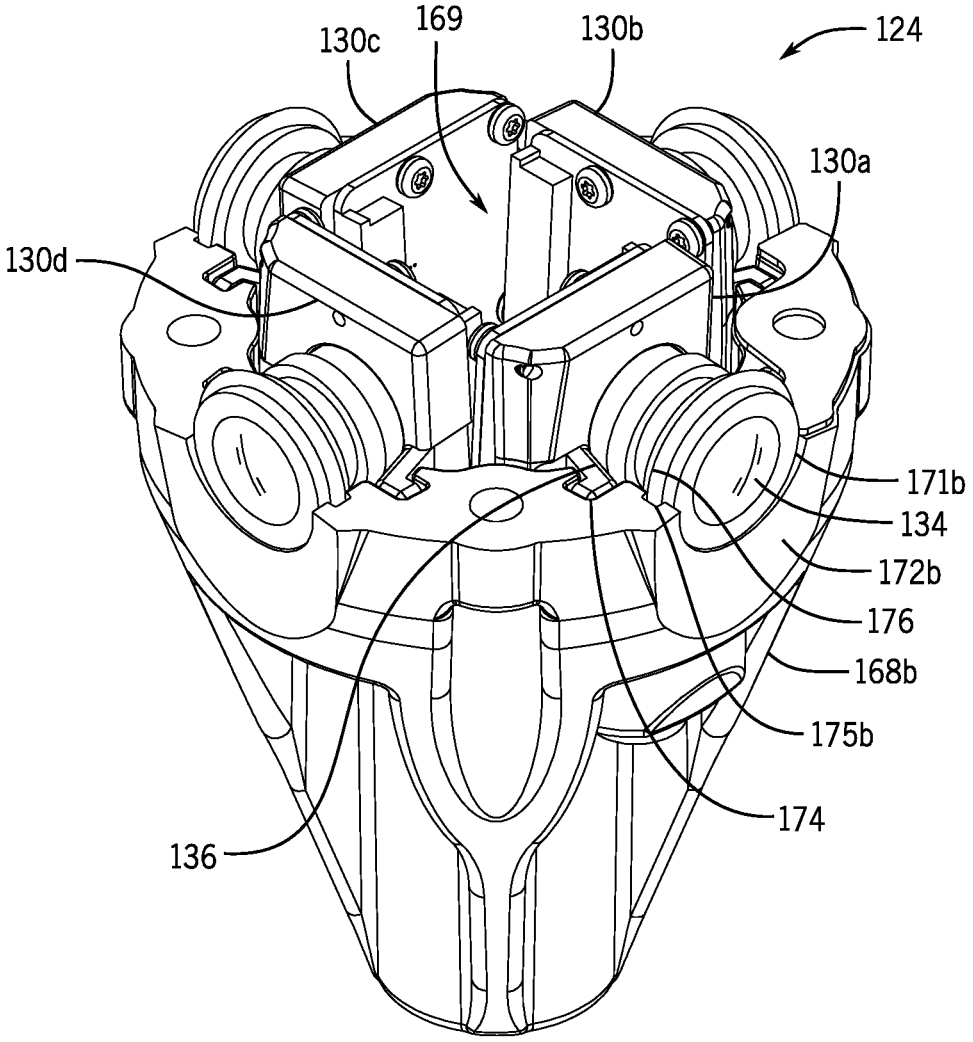
FIG. 7 depicts a sensor array arranged with a mating structure of the compartment assembly of FIG. 4.

The computing assembly 140 may be coupled to the sensor 130 within the flagstick 120. For purposes of illustration, FIG. 6 illustrates the sensor 130 as a camera sensor. The camera sensor is configured to capture images (still and video) and transmit information associated with the captured images to the circuit board 142 for processing. The sensor 130 is shown in the exploded view of FIG. 6 as including a sensor board 131 and a sensor housing 132. The sensor housing 132 may define a structural component of the sensor 130 that facilitates the attachment of sensing components of the sensor 130 to the sensor array housing 168. For example, the sensor housing 132 may include sensor housing clips 136 that extend outwardly from a body of the sensor 130 in order to maintain an alignment of the sensor housing 132 at a predetermined orientation in the sensor array housing 168 (FIG. 7). The sensor housing 132 may further include a sensor housing attachment feature 137. The sensor housing attachment feature 137 may be a loop, hook, or protrusion-type feature that is adapted to receive a fastener to secure the sensor housing 132 in the predetermined position, as aligned via the sensor housing clips 136.

In some implementations, the electronic golf flagstick 120 may be arranged at the cup 106 of a green on a golf course or other location of a golfing environment 102. As the golf ball 101 advances towards the cup of a green, for instance advances from the tee box of a golf hole to the cup of the golf hole, sensor 130 of the electronic golf flagstick 120 track the golf ball 101. A computing device 140 including a processor and memory 144 coupled to the sensor 130 may detect a position of the golf ball and/or track a path of the golf ball 101 from the vantage point of the electronic golf flagstick 120. In some implementations, the processor and memory 144 process the sensor data to determine the golf ball 101 as being received by the golf cup 106 in a single stroke. For example, the sensor 130 may detect the receipt of the golf ball 101 in the golf cup 106 along with the flight of the golf ball from a tee box of the golf hole associated with the golf cup 106. The processor and memory 144 may associate the receipt of the golf ball 101 in the golf cup 106 with data indicative of a number of strokes used by a golfer to advance the golf ball 101, such as the number of strokes from a tee box or other reference point in the golfing environment 102. Upon the association of a single stroke being used to advance the received golf ball 101 into the golf cup 106, the golf ball 101 may be classified as a hole-in-one by the processor. In some implementations, the processor and memory 144 processes the sensor data to determine a distance between the golf ball 101 and the golf cup 106 using the detected position. Where multiple golf balls 101 are in play, the determined distance may be compared by the processor and memory 144 among a set of determined distances to determine the closest golf ball 101 to the cup 106. Additionally, image data may be captured by the sensor 130 at the electronic golf flagstick 120 and the processor and memory 144 may store a visual representation of the golf ball 101 as the ball approaches the golf cup 106, including in some cases a composite 360° video. The image data may be transmitted by the computing device 140 over the network 108 where further data analysis may be remotely performed on the image data. In some implementations, the network devices, e.g., management device 118 and/or computing server 116, may substantially simultaneously process the image data captured by the sensor 130. In addition or alternatively, the network devices may be configured to validate the image data captured by the sensor 130 to confirm the accuracy of the computing device 140 operations.

The processor and memory 144 and the communications component 148 may be configured to determine GPS coordinates of one or both of the golf ball 101 and the electronic golf flagstick 120. Images or video captured by the sensor 130 may be associated with the determined GPS coordinates and the information transmitted by the communications component 148 over the network 108 for subsequent processing or use.

In some implementations, the network 108 may be configured to power on and off the remotely located electronic golf flagstick 120, and the network 108 may transmit software updates to the processor and memory 144. For instance, the computer server 116 may be configured as a centralized hub for the network 108 and may be used to remotely monitor the status of the electronic golf flagstick 120 and receive and transmit data and instructions to each of the electronic golf flagstick 120 coupled to the network 108.

The processor and memory 144 may also be used to support the creation of the composite video upon receipt of signals from the sensor 130. This may include preparing and/or routing the video files for transmission across a distributed computer network 108 for analysis and a remote computer server 116, and the communications component 148 may be configured as an antenna that is coupled with the processor and memory 144 to wirelessly transmit the data of the at least one sensor 130 over a network 108. The power source 152 may provide a localized, onboard power supply for the electronic components of the electronic golf flagstick 120 and may therefore operate as a self-contained unit that does not require a hardwired connection to peripheral devices or power sources during operation. In some implementations, the electronic golf flagstick 120 may include a recharging port such as a USB port for recharging the power source 152, and when the port may be further configured to couple to a computer for receipt of updates at the processor and memory 144, for example.

Where multiple electronic golf flagsticks 120 are arranged at a golf hole, such as one electronic golf flagstick 120 at the hole of a golf green, and another electronic golf flagstick 120 at the tee of the golf hole, the electronic golf flagsticks 120 may be communicatively coupled and the sensed information from the respective sensors 130 may be used to verify the sensed information collected by the sensor 130 of the other of the electronic golf flagsticks 120 associated with this same golf hole. This verification data may be transmitted over the network 108, for instance, to confirm the accuracy of the collected information related to the tracking of the golf ball 101 or other tracked information, such as movement of the electronic golf flagsticks 120 from an assigned or predetermined position. Where multiple electronic golf flagsticks 120 are housed at the same golf course, such as at four or more golf holes of a particular golf course, the multiple electronic golf flagsticks 120 may be communicatively coupled to each other, and/or may be communicatively coupled to a user device 110 that may be associated with the golf course. In this way, an administrative user of the device 110 may track the use and position of the multiple electronic golf flagsticks 120 at the golf course.

The electronic golf flagstick 120 may be configured to deliver substantially real-time information to a golfer or other user. For instance, after a golf ball 101 is tracked by the sensor 130, the electronic golf flagstick 130 may transmit images of the golf ball 101 as a picture or as a video to a user's device 110 such as a mobile phone so that the user can view a golf shot from the perspective of the electronic golf flagstick 120. In some implementations, the processor and memory 144 may be configured to receive sensor information from multiple sensors 130*a-d* and generate a composite, stitched together video from the individual videos captured by these various sensors 130*a-d*. For instance, the processor and memory 144 may filter the videos and provide frame relevant information, allowing the video to include or emphasize frames including the golf ball and exclude non-relevant frames, such as those not including the golf ball. Frames including the golf ball and adjacent or target images may be stitched together by the processor and memory 144 to create up to a net 360° view of the golf ball as it approaches and/or enters the golf cup. The composite video may be saved by the golfer for reference and distribution subsequent to the golf game. The system 100 and its components may also facilitate communicating other messages to the golfer or third parties via the user device 110, including the determined distance of the golf ball to the golf cup.

The sensor board 131 may be a backing or other circuit board that defines a mounting for sensing components of the sensor 130. The sensor board 131 may be secured to the sensor housing 132 via fasteners 139. The sensing components of the sensor 130 may include various components of a video or image sensor. For purposes of illustration, FIG. 6 shows the sensor 130 including a lens piece 134, a first lens tube portion 133*a*, a second lens tube portion 133*b*, and a lens-mating piece 135. The lens piece 134 may include a portion of an optical lens. In this regard, the lens piece 134 may define an outermost portion of the sensor 130 that is adapted to receive light. The received light may be indicative of an image of the golf ball 101 or other aspect of the golfing environment 102. The lens piece 134 may be associated with a first lens tube portion 133*a* and the second lens tube portion 133*b*. The first and second lens tube portions 133*a*, 133*b* may cooperate to collimate or otherwise manipulate the received light for processing at the sensor board 131. The lens mating piece 135 may be a ring or other sealing-type element that fits over one or both of the first and second lens tube portions 133*a*, 133*b*. In some cases, the lens-mating piece 135 may be arranged at an interface between the first and second lens tube portions 133*a*, 133*b*. Further, the first and second tube portions 133*a*, 133*b* may be configured to extend through the sensor housing 132 and the mating piece 135 may define an engagement or seal between the first or second tube portions 133*a*, 133*b* and the sensor housing 132, thereby facilitating alignment of the sensing component of the sensor 130 with respect the sensor housing 132.

In the assembled configuration, the sensor 130 and the computing assembly 140 may be coupled with one another and arranged within the compartment assembly 122. For example and with reference to FIG. 3, the computing assembly 140 may be held within the tube 160. The computing assembly mounting structure 141, for example, may have a shape matching the cylindrical walls 162 of the tube 160. Accordingly, the computing assembly mounting structure 141 and associated electric components may be slid into the tube volume 161. In some cases, the computing assembly mounting structure 141 may define a friction fit with an interior surface of the cylindrical walls 162 inside of the tube volume 161.

The sensor 130 may be arranged with the compartment assembly 122 at the sensor array housing 168. Broadly, the sensor array housing 168 may be configured to secure the sensor 130 at a predetermined position and alignment within the electronic golf flagstick 120. In one implementation, as shown in FIG. 7, the sensor array housing 168 may be configured to secure multiple sensors at predetermined positions and alignments within the electronic golf flagstick 120. For example, FIG. 7 shows the sensor array 124 as including a first sensor 130*a*, a second sensor 130*b*, a third sensor 130*c*, and a fourth sensor 130*d*. The sensor 130 described herein may be representative of any one or more of, or all of, the first sensor 130*a*, the second sensor 130*b*, the third sensor 130*c*, and the fourth sensor 130*d*.

The first, second, third, fourth sensors 130*a*-130*d* are shown in FIG. 7 held in a predetermined position by the sensor array housing second portion 168*b*. Each of the sensors 130*a*-130*d* are arranged to face a different direction. In the example of FIG. 7, each sensor 130*a*-130*d* faces a direction that is substantially orthogonal to an adjacent sensor. As explained in greater detail below, this arrangement may allow the sensors 130*a*-130*d* to collectively capture a net 360° view about the flagstick 120. In other examples, more or fewer sensors may be used.

The sensor array housing second portion 168*b* may define a series of features to facilitate the alignment of the sensors 130*a*-130*d* within the sensor array housing 168. For example, the sensor array housing second portion 168*b* may define clip seats 174 for each of the sensors 130*a*-130*d*. The clip seats 174 may be grooves defined adjacent the sensor bottom support feature 171*b*. The clip seats 174 may be configured to receive the sensor housing clip 136. Upon receipt of the sensor housing clip 136 in the clip seats 174, the sensor 130 may be restrained from axial movement within the sensor array housing second portion 168*b*. The sensor array housing second portion 168*b* may further define a seal bottom seat 175*b* for each of the sensors 130*a*-130*d*. The seal bottom seat 175*b* may be a groove that is configured to receive a sealing element, such as an O-ring or seal 176.

Figure 8:
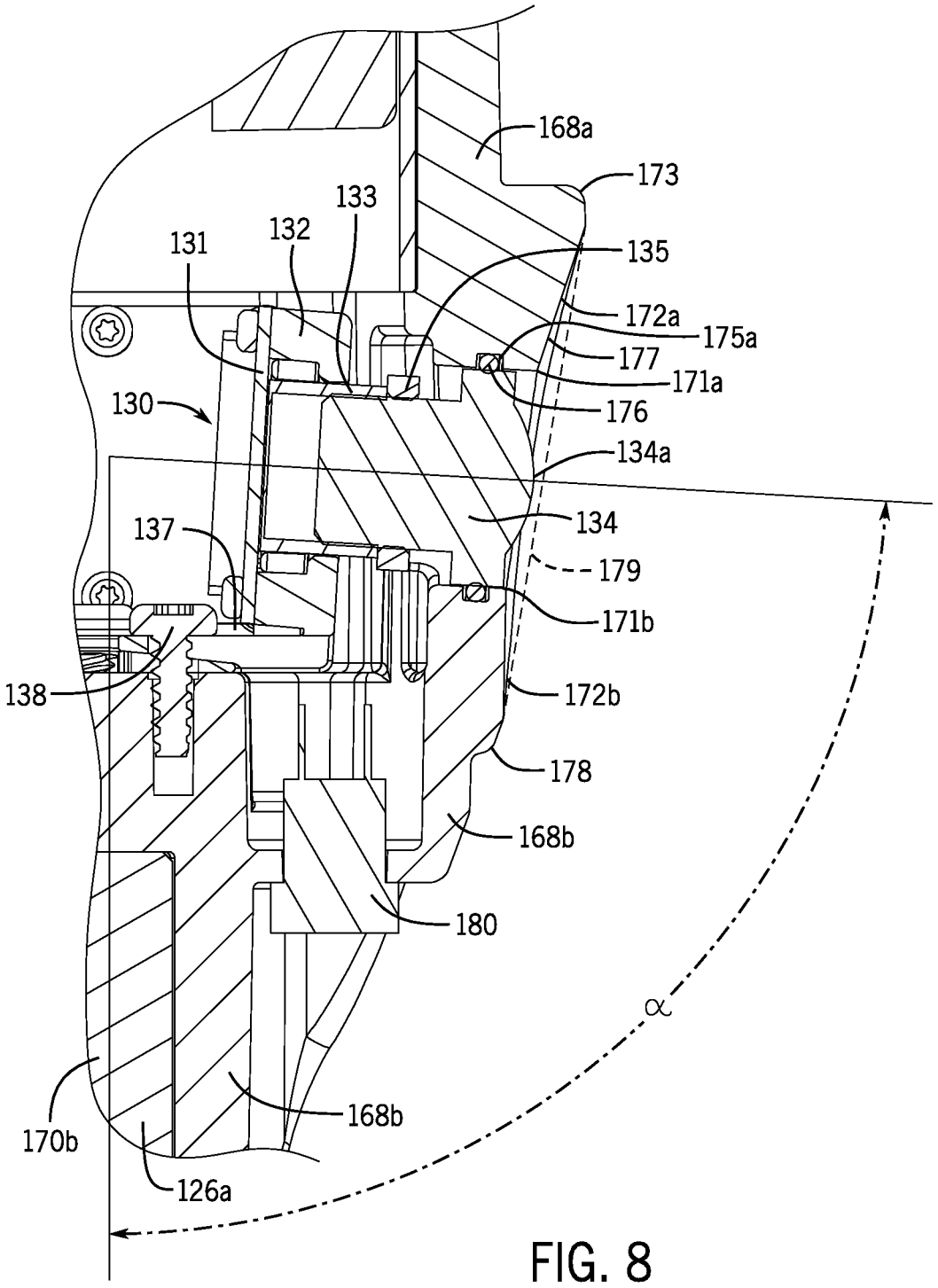
FIG. 8 depicts detail 8-8 of FIG. 3.

In the assembled configuration, the sensor array housing first portion 168*a* may be attached to the sensor array housing second portion 168*b* (see e.g., FIG. 3). The sensor array housing first and second portions 168*a*, 168*b* may substantially enclose the sensors 130*a*-130*d* with the housing volume 169. With reference to FIG. 8, detail 8-8 of FIG. 3 is depicted which shows the sensor array housing first and second portions 168*a*, 168*b* in the assembled configuration. As shown in FIG. 8, a seal upper seat 175*a* may be defined by the sensor array housing first portion 168*a*. The seal upper seat 175*a* may receive the seal 176. The seal 176 may therefore be used to define a weather-resistant barrier between the external environment of the flagstick 120 and the sensor array housing volume 169.

As demonstrated in FIG. 8, the sensor array housing first and second portions 168*a*, 168*b* may cooperate to arrange the sensor 130 at angle of less than 90° relative to a ground surface. For example, the sensor array housing first and second portions 168*a*, 168*b* may cooperate to arrange the lens 134 of the sensor 130 so that the lens faces a direction or otherwise defines an axis that is orientated at an angle $\alpha$ relative to a ground surface. The angle $\alpha$ may be less than 90°, such as being less than 89°, preferably as being less than 88°, or more preferably being less than 87°. More broadly, the angle $\alpha$ may be any appropriate angle that allows the lens 134 to capture images of the golf cup 106. Accordingly, the lens 134 may be configured to capture images substantially adjacent to or at the golf cup 106, allowing the electronic golf flagstick 120 to create a visual representation of the golf ball 101 as it is advanced toward and into the golf cup 106. In some implementations, the sensor 130 is configured to sense or capture images of an area remote from the electronic golf flagstick 120 arranged in the golf cup 106, and for example, may capture images of a tee box associated with the same golf hole where the golf cup 106 is situated. In this way, the sensor 130 may sense a flight of the golf ball 101 from a tee box to the golf cup 106 in cases where the golf ball travels directly from the tee box to the golf cup in one shot, or a hole-in-one.

To facilitate the foregoing, the sensor 130 is secured to the sensor housing second portion 168*b* in a manner that maintains the orientation of the lens 134 at the angle $\alpha$. For example, a fastener 138, such as a screw, may be used to positionally fix the sensor housing attachment feature 137 of the sensor 130 to the sensor array second portion 168*b*. The sensor board 131 and sensor housing 132 may be arranged at a non-perpendicular angle from the sensor housing attachment feature 137. For example, the sensor board 131 and the sensor housing 132 may extend at an angle from the sensor housing attachment feature 137 that allows the lens 134 to be positioned substantially at the angle α when the sensor housing attachment feature 137 is secured to the sensor array housing second portion 168*b* with the fastener 138. And the sensor housing clip 136 being seated in the respective clip seats 174 may substantially prevent the lens 134 from deviating from the angle α during use.

The sensor array housing first and second portions 168*a*, 168*b* may cooperate to shield the sensor 130 from damage. For example, the sensor array housing first and second portions 168*a*, 168*b* may be configured to impede a ground surface from contacting the sensor 130 in the event that the electronic golf flagstick 120 is laid on a ground surface. To facilitate the foregoing, the sensor array housing first portion 168*a* may define a top ridge 173 and the sensor array housing second portion 168*b* may define a bottom ridge 178. The top and bottom ridges 173, 178 may be protrusions or other features that extend from an outer surface of the sensor array housing 168. The top and bottom ridges 173, 178 may form a recessed region 177 therebetween. The sensor 130 may be substantially arranged at the recessed region 177 and between the top and bottom ridges 173, 178. For example and in the assembled configuration shown in FIG. 8, the top ridge 173 may be positioned on a first or top side of the sensor 130. Further, the bottom ridge 178 may be positioned on a second or bottom side of the sensor 130. The top and bottom ridges 173, 178 may extend outward from the sensor array housing 168 in a manner that allows the lens 134 to be offset from a ground surface upon the top and bottom ridges 173, 178 impacting the ground surface. To illustrate, a linear span 179 may be defined between the ridge 173, 178. The linear span 179 may be indicative of a ground surface, with the ridge 173, 178 contacting the ground surface. As shown in FIG. 8, a lens end 134*a* is within the recessed region and offset from the linear span 179. In this manner, the lens end 134*a* may not contact the ground surface represented by the linear span 179, thereby mitigating damage to the sensor 130 and/or other components in the event the flagstick is laid on the ground.

Further shown in FIG. 8 is an actuation switch 180. The actuation switch 180 may be electrically couple to the circuit board 142. The actuation switch 180 may be configured to receive a user input. Upon receipt of the user input, the actuation switch may send a signal to the circuit board 142 to initiate one or more of the operations described herein. In some cases, the actuation switch 180 may include a mechanical switch and/or tactile features to provide an indication to the user that the input was received.

The compartment assembly 122 including the various electrical components described herein is attached to the elongated pole 126. For example, the compartment assembly 122 may be configured to attach to the elongated pole first portion 126*a* at the sensor array housing second portion 168*b*. As shown in FIG. 8, the fitting portion 170*b* of the sensor array housing second portion 168*b* may be a recess extending into the body of the sensor array housing second portion 168*b*. The fitting portion 170*b* may be configured to receive the elongated portion first portion 126*a*. Further, the compartment assembly 122 may be configured to attached to the elongated pole second and/or third portions 126*b*, 126*c* at the cap 164. With reference to FIG. 9, the elongated pole third portion 126*c* is shown received by the elongated pole opening 165 of the cap 164. The elongated pole portions 126*a*-126*c* may be attached to the compartment assembly 122 via friction fit with the respective the fitting portion 170*b* and opening 165. Additionally or alternatively, adhesive, fasteners, or other attachment structures may be used.

The assembled configured of FIG. 9 also shows the cap 164 attached to the tube 160. For example, the fitting portion 166 of the cap 164 is shown received by the tube 160. Seals 183*a*, 183*b* may be provided in order to establish a moisture-resistant connection between the cap 164 and the tube 160. A fastener 184 may be provided to positionally secure the cap 164 relative to the tube 160. The detail view of FIG. 9 further shows a compartment 185. Broadly, the compartment 185 may be a section of the cap 164 or other feature of the compartment assembly 122 that is configured to receive a communications component. For example, the compartment 185 may be configured to optionally receive an antenna or other component to facilitate the transmission of wireless signals to and from the electronic golf flagstick 120.

Additionally or alternatively, the compartment 185 may be configured to receive a conduit 186 that connects the antennas 187*a*, 187*b* to a communications component or other component housed in the compartment assembly 122. For example, the conduit 186 may be received through the compartment 185 and routed into the third portion volume 129*c* of the elongated pole third portion 126*c*. The conduit 186 may continue into the second portion volume 129*b* of the elongated pole second portion 126*b* and/or end volume 123 at which the antennas 187*a*, 187*b* are housed. The conduit 186 may be a carrier or otherwise define a housing or cable for wires 188*a*, 188*b* that are coupled to respective ones of the antennas 187*a*, 187*b*. The wires 188*a*, 188*b* may extend in any appropriate direction to communicatively couple with the antennas 187*a*, 187*b*, which may be diametrically opposed from one another at the second end 127*b*.

Figure 10:
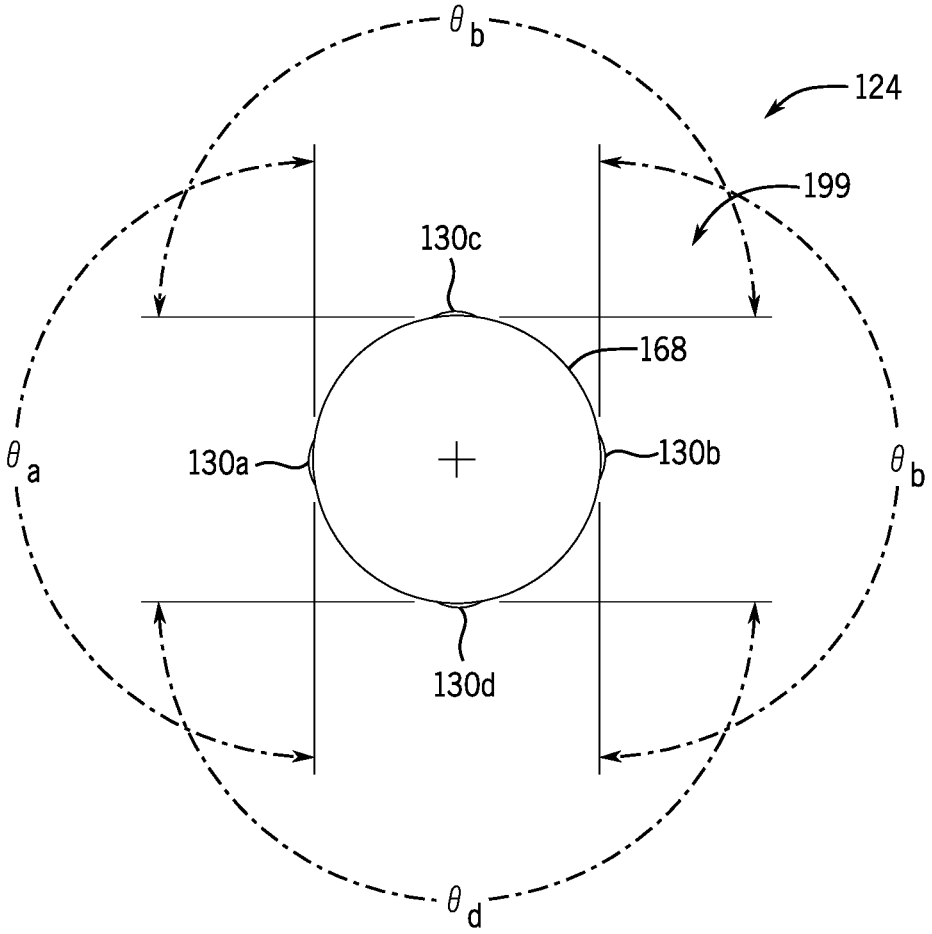
FIG. 10 depicts a schematic diagram of a composite field of view of the sensor array of the electronic golf flagstick of FIG. 1.

In some implementations, the sensor 130 generates a visual representation of the golf ball and the surrounding environment proximate the electronic golf flagstick 120. In some cases, multiple sensors 130*a*-*d* (e.g., cameras, LIDAR-type sensors) may be configured to sense different portions of the same golf environment 102 and the computing device 140 may be configured to generate a composite view or video of a 360° view of the golf environment 102 surrounding the electronic golf flagstick 120. Turning to FIG. 10, a schematic representation of the sensor array 124 of the electronic golf flagstick 120 is presented. In FIG. 10, each of the sensors 130*a*-130*d* are shown schematically positioned about the sensor array housing 168. Each of the sensors 130*a*-130*d* may be configured to capture a 180° view of the area proximate to the sensor array housing 168. For example, the first sensor 130*a* may have a first field of view Oa, the second sensor 130*b* may have a second field of view $\theta_b$, the third sensor may have a third field of view $\theta_c$, and the fourth sensor 130*d* may have a fourth field of view $\theta_d$. Each of the field of views $\theta_a$-$\theta_d$ may define an approximately 180° field of view for the respective one of the sensors 130*a*-130*d*. The field of views may therefore overlap with one another, such as at an overlap portion 199. In some cases, one or more or all of the field of views $\theta_a$-$\theta_d$ may be less than 180° while maintaining the overlap portion 199 between adjacent sensors 130. With the overlap portion 190 maintained, the sensor 130*a*-130*d* may collectively capture a 360° view of the ground surface about the electronic golf flagstick 120. Accordingly, the images captured by the sensors 130*a*-130*d* may be used to form a composite or stitched together video or other visual representation of the golf ball 101 regardless of the direction at which the golf ball 101 approaches the flagstick 120.

Other examples and implementations are within the scope and spirit of the disclosure and appended claims. For example, features implementing functions may also be physically located at various positions, including being distributed such that portions of functions are implemented at different physical locations. Thus, the foregoing descriptions of the specific examples described herein are presented for purposes of illustration and description. They are not targeted to be exhaustive or to limit the examples to the precise forms disclosed. It will be apparent to one of ordinary skill in the art that many modifications and variations are possible in view of the above teachings.

What is claimed is:

1. An electronic golf flagstick configured for sensing objects proximate the golf flagstick, comprising:

an elongated pole comprising a first end and a second end extending along a longitudinal axis, the first end adapted to be removably secured to a surface; and a compartment assembly arranged along the longitudinal axis between the first end and the second end, the compartment assembly comprising:

a sensor array housing comprising at least two sensor top support features and at least two sensor bottom support features which together define openings in a circumferential surface of the sensor array housing; and at least two sensors disposed within a respective one of the openings of the sensor array housing, wherein the sensor array housing positions the at least two sensors within the respective openings at any appropriate angle relative to elongated pole that allows the at least two sensors to be configured to capture data substantially adjacent to the first end of the elongated pole;

wherein an external portion of each of the sensor top support feature comprises at least one protrusion arranged above each of the at least two sensors and extending outwardly beyond an outermost surface of each of the at least two sensors;

wherein each of the protrusions and outermost surfaces of each bottom support feature define a linear span from which the outermost surface of each of the at least two sensors is recessed.

2. The electronic golf flagstick of claim 1, wherein the at least two sensors are together configured to capture images including a 360 degree view of an area surrounding the elongated pole.

3. The electronic golf flagstick of claim 1, wherein the at least two sensors are in electronic communication with a processor.

4. The electronic golf flagstick of claim 3, wherein the processor comprises at least one of a processor disposed in the compartment assembly or a remote processor.

5. The electronic golf flagstick of claim 3, wherein the at least two sensors are configured to sense an object proximate to the golf flagstick, and the processor is configured to analyze the object and at least one of:

determine the object as being received by a golf cup in a single stroke, or classify the object as a hole-in-one.

6. The electronic golf flagstick of claim 3, wherein the at least two sensors are configured to sense an object proximate to the golf flagstick, and the processor is configured to analyze the object and calculate a distance of the object from the electronic golf flagstick.

7. The electronic golf flagstick of claim 3, wherein the at least two sensors are configured to sense an object proximate to the golf flagstick, and the processor is configured to calculate a distance of the object from the electronic golf flagstick for a plurality of objects such that the processor calculates a relative distance of each object to the electronic golf flagstick.

8. The electronic golf flagstick of claim 3, wherein the at least two sensors are configured to sense an object proximate to the golf flagstick, and the processor is configured to sense GPS coordinates of at least one of the electronic golf flagstick or of the object.

9. The electronic golf flagstick of claim 3, wherein the at least two sensors are configured to sense an object proximate to the golf flagstick and comprise video cameras configured to record a video of the object.

10. The electronic golf flagstick of claim 9, wherein the video cameras each record a 180 degree video of an area proximate the object.

11. The electronic golf flagstick of claim 9, wherein the processor is configured to transmit the recorded video over a computer network.

12. The electronic golf flagstick of claim 3, wherein the processor is communicatively coupled to a computer network.

13. The electronic golf flagstick of claim 1, wherein the compartment assembly comprises a tubular housing with an enlarged diameter relative to a diameter of the elongated pole.

14. The electronic golf flagstick of claim 1, wherein the surface is configured as a tubular wall, the first end of the elongated pole comprising a base with a shape complementary to the tubular wall such that the base of the elongated pole may be removably inserted into an opening defined by the tubular wall.

15. The electronic golf flagstick of claim 1, wherein the surface is formed by a golf cup of a golf hole.

16. An electronic golf flagstick communicatively coupled over a network, the electronic golf flagstick configured for sensing objects proximate the golf flagstick, comprising:

an elongated pole comprising a first end and a second end extending along a longitudinal axis, the first end adapted to be removably secured to a golf cup of a golf hole; and a compartment assembly arranged along the longitudinal axis between the first end and the second end, the compartment assembly comprising:

a sensor array housing comprising at least two sensor top support features and at least two sensor bottom support features which together define openings in a circumferential surface of the sensor array housing;

at least two lens tubes coupled to the sensor array housing;

at least two sensor assemblies, each including a sensor, a lens piece, and a processor communicatively coupled to the network, disposed within a respective one of the openings of the sensor array housing and received in a respective one of the at least two lens tubes;

wherein the sensor array housing positions the at least two sensors within the respective openings at any appropriate angle relative to elongated pole that allows the at least two sensors to be configured to capture data substantially adjacent to the first end of the elongated pole;

wherein an external portion of each of the sensor top support feature comprises at least one protrusion arranged above each of the at least two sensor assemblies and extending outwardly beyond an outermost surface of each of the at least two sensor assemblies;

wherein each of the protrusions and outermost surfaces of each bottom support feature define a linear span from which the outermost surface of each of the at least two sensors is recessed.

17. The electronic golf flagstick of claim 16, each of the plurality of sensors is configured to sense a golf ball proximate the golf flagstick and determine the golf ball as being received by a golf cup in a single stroke or classify the golf ball as a hole-in-one, and wherein the processor is configured to transmit a message indicative of the determination over the network to a computing server, and in response, the server validates the determination.

18. An electronic golf flagstick communicatively coupled over a network, the electronic golf flagstick configured for sensing objects proximate the golf flagstick, comprising:

an elongated pole comprising a first end and a second end extending along a longitudinal axis, the first end adapted to be removably secured to a golf cup of a golf hole;

a sensor array housing coupled to the elongated pole arranged along the longitudinal axis and comprising a plurality of sensor top support features and a plurality of sensor bottom support features which together define openings in a circumferential surface of the sensor array housing;

a plurality of lens tubes coupled to the sensor array housing;

a plurality of sensor assemblies, each including a sensor and a lens piece received in a respective lens tube of the plurality of lens tubes and fixedly arranged within a respective one of the openings at any appropriate angle relative to elongated pole that allows the plurality of sensors to be configured to capture data substantially adjacent to the first end of the elongated pole;

wherein an external portion of each of the sensor top support feature comprises at least one protrusion arranged above each of the plurality of sensor assemblies and extending outwardly beyond an outermost surface of each of the plurality of sensor assemblies;

wherein each of the protrusions and outermost surfaces of each bottom support feature define a linear span from which the outermost surface of each of the plurality of sensor assemblies is recessed.

19. The electronic golf flagstick of claim 18, wherein the plurality of lens tubes are configured to position the plurality of sensor assemblies therein such that, during operation, the plurality of sensors sense image data corresponding to a net 360 degree view of an area surrounding the electronic golf flagstick.

20. The electronic golf flagstick of claim 19, further comprising:

a computing assembly coupled to the elongated pole, the computing assembly comprising a processor communicatively coupled to the plurality of sensors and the network; and an actuation switch coupled to the elongated pole, the actuation switch electrically coupled to circuitry of the computing assembly and configured to receive user input for causing the computing assembly to operate the plurality of sensors, wherein the processor is configured to transmit the image data over the network to a computing server.

* * * * *